US006823938B1

(12) United States Patent
Milberger

(10) Patent No.: US 6,823,938 B1
(45) Date of Patent: Nov. 30, 2004

(54) LOCATOR AND HOLDDOWN TOOL FOR CASING HANGER RUNNING TOOL

(75) Inventor: Lionel J. Milberger, Houston, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/244,225

(22) Filed: Sep. 16, 2002

Related U.S. Application Data

(60) Provisional application No. 60/325,039, filed on Sep. 26, 2001.

(51) Int. Cl.[7] ..... E21B 23/00

(52) U.S. Cl. ..... 166/209; 166/208; 166/216; 166/217; 166/382

(58) Field of Search ..... 166/209, 216, 166/217, 382, 208

(56) References Cited

U.S. PATENT DOCUMENTS 4,993,493 A * 2/1991 Arnold ..... 166/382

5,105,888 A * 4/1992 Pollock et al. ..... 166/348

* cited by examiner

*Primary Examiner*—David Bagnell
*Assistant Examiner*—Giovanna Collins
(74) *Attorney, Agent, or Firm*—Bracewell & Patterson, L.L.P.

(57) ABSTRACT

A tool is used for installing a string of casing in a well. The casing is supported by a casing hanger that lands on a landing shoulder of the wellhead assembly. A running mechanism is releasably secured to the casing hanger for landing the casing hanger and setting a casing hanger seal. A profile is formed in the wellhead assembly above the landing shoulder. The tool includes a body having an upper portion and a lower portion, the lower portion being secured to the running mechanism. A mandrel is mounted to the body for axial movement relative to the body, the mandrel having a threaded upper end for securing to a running string of conduit. A cam surface is formed on the mandrel. A plurality of dogs are mounted to the upper portion of the body in sliding engagement with the cam surface for movement in response to axial movement of the mandrel into engagement with the profile. While in the engaged position, the dogs resist upward movement of the casing hanger during cementing of the string of casing.

12 Claims, 4 Drawing Sheets

LOCATOR AND HOLDDOWN TOOL FOR CASING HANGER RUNNING TOOL

This application claims priority from the provisional application Ser. No. 60/325,039, filed Sep. 26, 2001 entitled "Locator and Holddown Tool for Casing Hanger Running Tool".

FIELD OF THE INVENTION

This invention relates in general to running casing hangers for offshore wells, and in particular to a tool that provides an indication that a subsea casing hanger has properly landed and provides a hold down for the casing hanger and casing string while cement is being pumped through the casing string.

BACKGROUND OF THE INVENTION

In one type of offshore drilling, a wellhead housing is located at the sea floor. One or more strings of casing extend in the well, each being supported by a casing hanger in the wellhead housing. The casing hanger is run on a running tool, which also sets a seal between the casing hanger and the wellhead housing after the casing has been cemented.

In the Gulf of Mexico, a shallow formation that must be drilled through often requires an additional casing string over what would normally be used. In one technique, the wellhead assembly includes a sub that extends below the wellhead housing. A first string of casing extends downward from the sub. A landing shoulder is provided in the sub for landing a casing hanger for a second string of casing. It is important that the casing hanger land on the landing shoulder before cementing occurs. Also, the casing hanger must remain on the landing shoulder during cementing. The cement returns flowing up the casing armulus tend to float the casing hanger upward.

SUMMARY OF THE INVENTION

The wellhead assembly has a profile located above the landing shoulder. The running tool assembly includes a hold down mechanism as well as a running mechanism. The hold down mechanism has a body mounted above the running mechanism. A plurality of dogs are mounted to the body for radial movement. After the casing hanger lands, the dogs are moved to an engaged position with the profile. The operator is able to pull upward on the running string to verify that the dogs are in engagement with the profile. While cementing, the cement returns flow past the dogs, with the dogs resisting any upward movement of the casing hanger.

In the preferred embodiment, the dogs are actuated by straight downward movement of the running string after the casing hanger has landed. The hold down mechanism has a mandrel with a cam surface that moves downward with the running string. A latch member between the mandrel and the hold down mechanism resists upward movement of the mandrel. The mandrel and a lower portion of the body are rotatable relative to theupper portion of the body, which holds the dogs. This allows the operator to rotate the running string, with the rotation transmitting through the mandrel and lower portion of the body to the running mechanism.

DETAILED DESCRIPTION OF THE INVENTION

Figure 1:
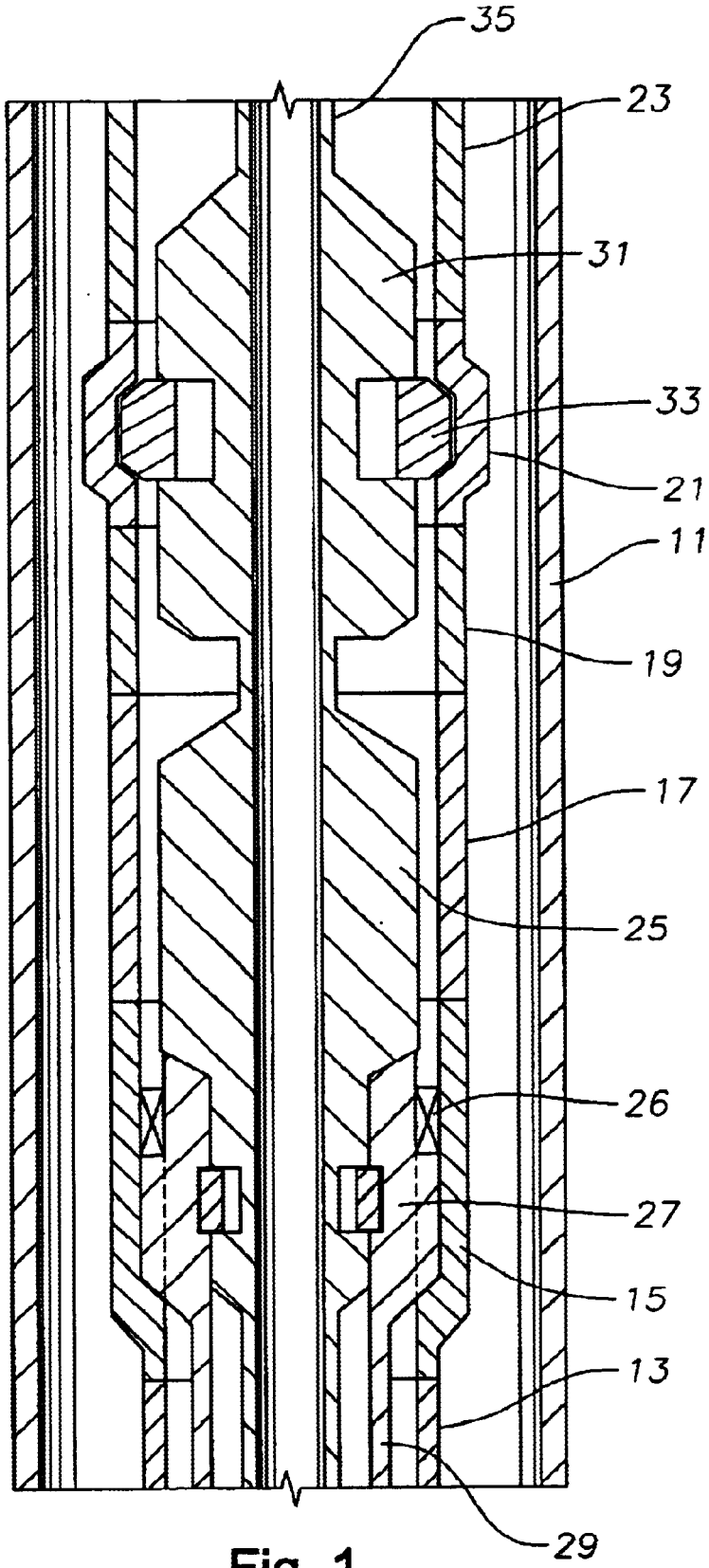
FIG. 1 is a schematic view illustrating a locator and hold down tool connected to a casing hanger running tool and constructed in accordance with this invention.

Referring to FIG. 1, a large diameter string of conductor pipe, typically 30", will be installed in the well to a first depth. Conductor pipe 11 is secured to the lower end of an outer or low pressure wellhead housing (not shown) that is located at the bottom of the floor. A string of casing 13 is lowered through a conductor pipe 11 and extends to a greater depth. Casing 13, for example, may be 22" in diameter. Casing 13 is supported on a hanger assembly that is secured to the lower end of a high pressure wellhead housing (not shown) that is landed in the low pressure wellhead housing.

The hanger assembly for casing 13 includes several components, one of these being a casing hanger landing sub 15 which has an internal upward facing shoulder in its bore. A spacer section 17, which may be the same diameter as casing 13, extends upward for a selected distance. A locator tool landing sub 19 is secured to the upper end of spacer section 17. Locator tool landing sub 19 has an upward facing shoulder in its bore. A locator tool hold down sub 21 is secured to the upper end of locator tool landing sub 19. Hold down sub 21 has an internal annular recess with both upward and downward facing shoulders therein. An upper pipe section 23 extends upward from hold down sub 21 to the high pressure wellhead housing (not shown). Components 15, 17, 19 and 21 are shown to be separate members secured together, but they could be partially or integrally formed together.

A conventional casing hanger running tool mechanism 25 secures to a casing hanger 27, which in turn supports a string of casing 29. Running tool 25 has dogs that engage a profile within the bore of casing hanger 27. Casing 29 extends to a deeper depth than casing 13 and may be 18" in diameter, for example. Casing hanger 27 lands on the upward facing shoulder in landing sub 15. Running tool 25 supports the weight of casing 29 while casing 29 is being lowered into the well. Running tool 25 also installs a seal or packoff 26 between casing hanger 27 and the inner diameter of casing hanger landing sub 15. Seal 26 is carried by running tool 25 while running tool 25 is lowering casing 29, however it is installed after cementing of casing 29 has been completed.

In certain geographic areas, such as portions of the Gulf of Mexico, there are shallow unconsolidated formations around 2000 feet that tend to wash out. As a result, during the cementing operation, the cement returns flowing upward tend to cause casing 29 to float upward even though casing hanger 27 may have been initially landed on the shoulder in landing sub 15. Eventually, the flowing cement returns may cause casing hanger 27 to lift above the shoulder in landing sub 15. It is important to be able to know that this has occurred before setting packoff 26 so that casing hanger 27 can be properly repositioned.

A locator tool 31, which may be considered to be part of running tool 25, informs the operator that casing hanger 27 has initially landed on the shoulder in landing sub 15. Also, locator tool 31 prevents casing hanger 27 from floating upward from the shoulder in landing sub 15 during cementing. Locator toot 31 lands on the shoulder in locator sub 19 and has dogs or locking elements 33 that will move radially outward to engage the recess in hold down sub 21. Once engaged, locking elements 33 prevent upward movement of running tool 25 and casing hanger 27. Locator tool 31 is lowered on a running string of conduit 35, normally drill pipe, at the same time as casing 13 is being run. Locator tool 31 will allow drill pipe 35 to rotate running tool 25 after locking elements 33 have set and will transmit that rotation to running tool 25 for performing the various functions needed to set casing hanger 27 and its packoff 26.

Figure 2A:
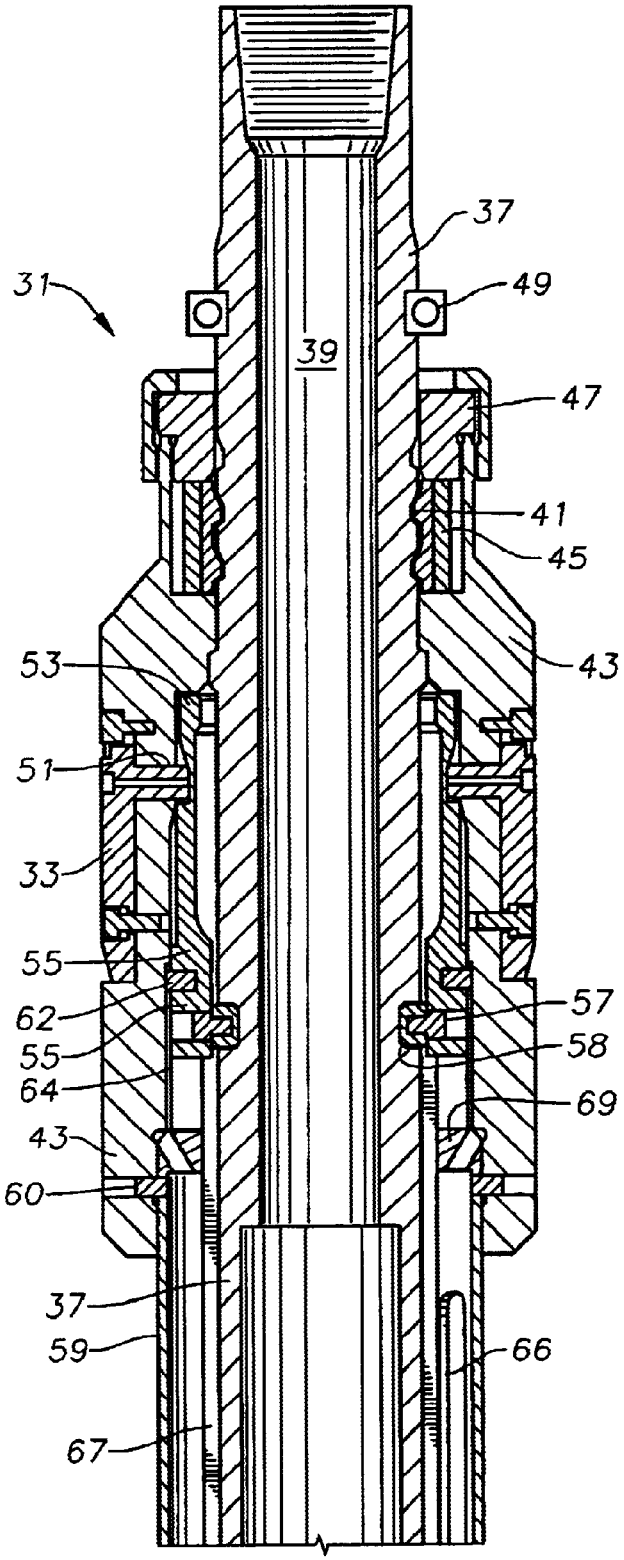
FIGS. 2A and 2B comprise a vertical sectional view of a locator and hold down tool constructed in accordance with this invention.

Referring to FIG. 2A, locator and hold down tool 31 includes a mandrel 37 that has a threaded upper end for securing to drill pipe 35 (FIG. 1). Mandrel 37 has a bore 39 through it for the passage of fluids used during cementing operations. A plurality of circumferential grooves 41 are formed on the exterior of mandrel 37. An upper body 43 is carried by mandrel 37 through a split ring 45 that engages circumferential grooves 41. Split ring 45 may be of multiple components, as shown, and is biased radially inward. Split ring 45 enables mandrel 37 to carry upper body 43 in a running-in position shown in FIG. 2A. Upper body 43 and mandrel 37 are axially movable relative to each other to a hold down position shown in FIG. 4A wherein mandrel 37 has moved downward relative to upper body 43. During the downward movement, split ring 45 ratchets on grooves 41. Split ring 45 is retained by a collar 47 secured to upper body 43. While in the hold down position of FIG. 4A, collar 47 will abut a stop 49 rigidly secured to mandrel 37.

Figure 4A:
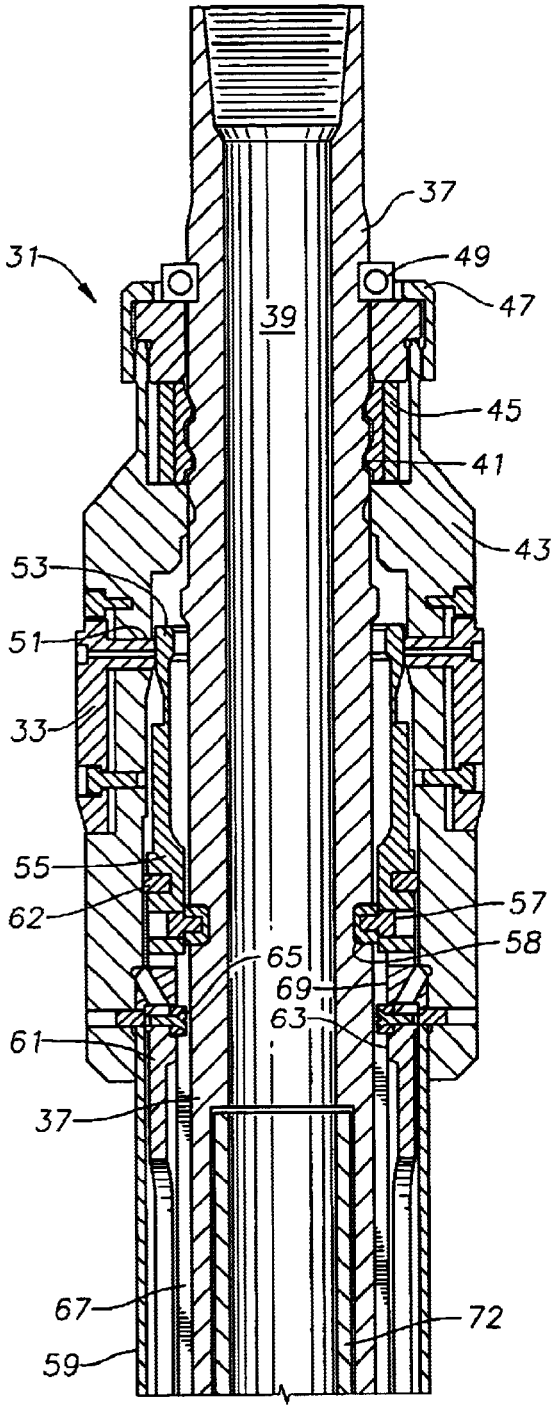
FIGS. 4A and 4B comprise a vertical sectional view of the tool of FIGS. 2A–2B shown in a second position after landing.

In this embodiment, locking elements 33 comprise dogs that are mounted to upper body 43 for radial movement between the running-in position shown in FIG. 2A and the hold down position shown in FIG. 4A. Each locking element 33 has a radial extension 51 that extends radially inward for engagement with a cam surface 53. Cam surface 53 is formed on the upper end of a collet member 55 that is mounted to mandrel 37 for axial movement therewith. When collet member 55 moves downward relative to locking elements 33, cam surface 53 will push extensions 51 and locking elements 33 radially outward. Collet member 55 and mandrel 37 serve as an actuator for moving dogs 33 to the engaged position.

Figure 2B:
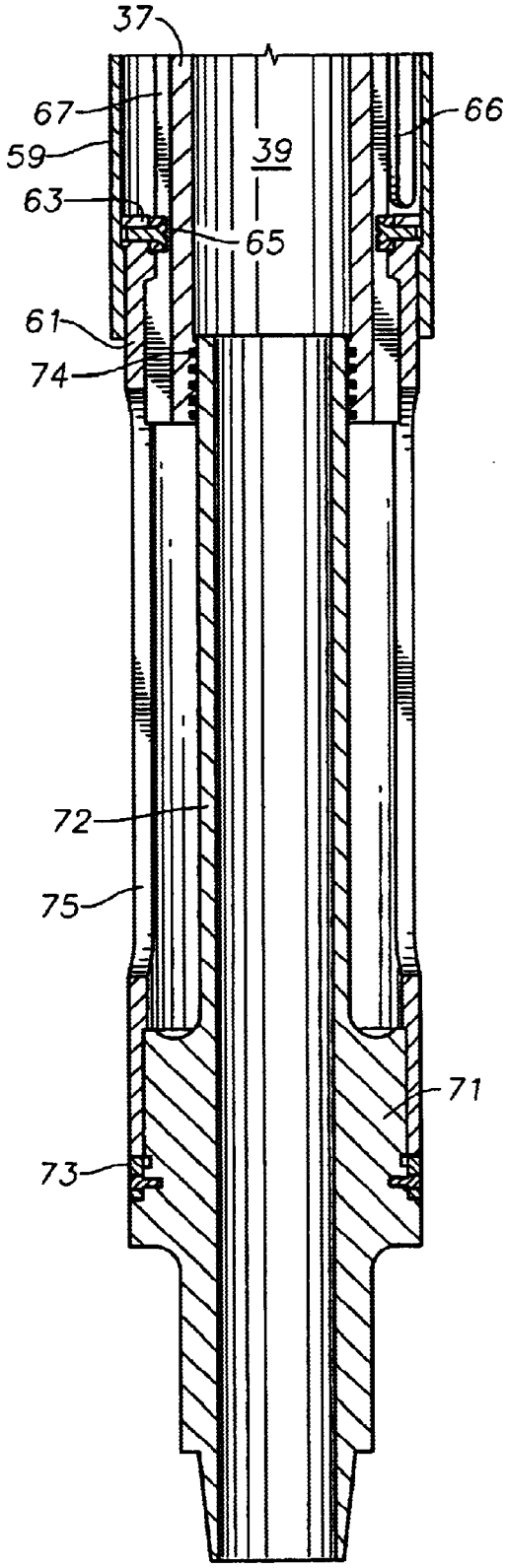

As shown in FIG. 2B, collet member 55 is secured by lock screws 57 to a ring 58 that engages an annular groove in mandrel 37. Ring 58 causes collet member 55 to move axially with mandrel 37, but allows mandrel 37 to rotate relative to collet member 55. Pins 62 extend outward from collet member 55 and engage splines 64 in upper body 43 to prevent rotation of collet member 55 while mandrel 37 is rotating.

Upper body 43 has a skirt 59 that extends downward from the lower end of upper body 43. Skirt 59 is a tubular member rigidly secured to upper body 43 by fasteners 60. A lower body 61 extends downward from upper body 43 in a telescoping manner. Lower body 61 is also a tubular member and is carried in the bore of skirt 59 of upper body 43 for axial movement between the running-in position shown in FIG. 2B and the hold down position shown in FIGS. 3B and 4B. Skirt 59 has a plurality of slots 66 in its sidewall to allow the venting of well bore fluid while lower body 59 moves upward relative to skirt 61. A shoulder 63 on the upper end of lower body 61 engages an upward facing shoulder formed in the inner diameter of skirt 59. Shoulder 63 retains lower body 61 with skirt 59 during running in but allows rotation relative between skirt 59 and lower body 61. A plurality of pins 65 extend radially inward from shoulder 63 and engage axial splines 67 formed on mandrel 37. Splines 67 and pins 65 transmit rotation from mandrel 37 to lower body 61. A stop 69 is located at the upper end of skirt 59 for limiting downward movement of skirt 59 relative to lower body 61.

Lower body 61 has a base 71 with a central tubular neck 72 protruding upward therefrom. Base 71 is mounted to lower body 61 by a plurality of fasteners 73, as shown in FIG. 2B and has a threaded lower end for securing to running tool 25 (FIG. 1). Fasteners 73 cause base 71 to move axially and rotationally with lower body 61. The upper end of neck 72 slides in a telescoping manner inside bore 39 of mandrel 37 and is sealed by seals 74 (FIG. 2B). Lower body 61 also has a plurality of slots 75 for the free flow of fluid in the well bore.

Figure 3A:
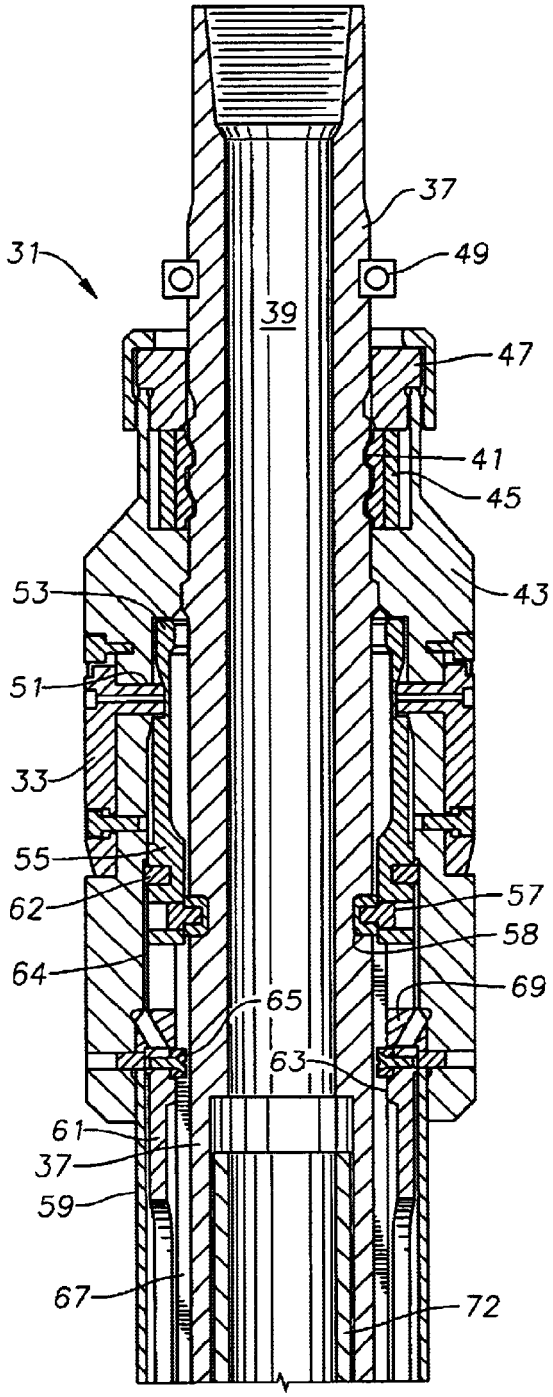
FIGS. 3A and 3B comprise a vertical sectional view of the tool of FIGS. 2A–2B as shown in a first position after landing.
Figure 3B:
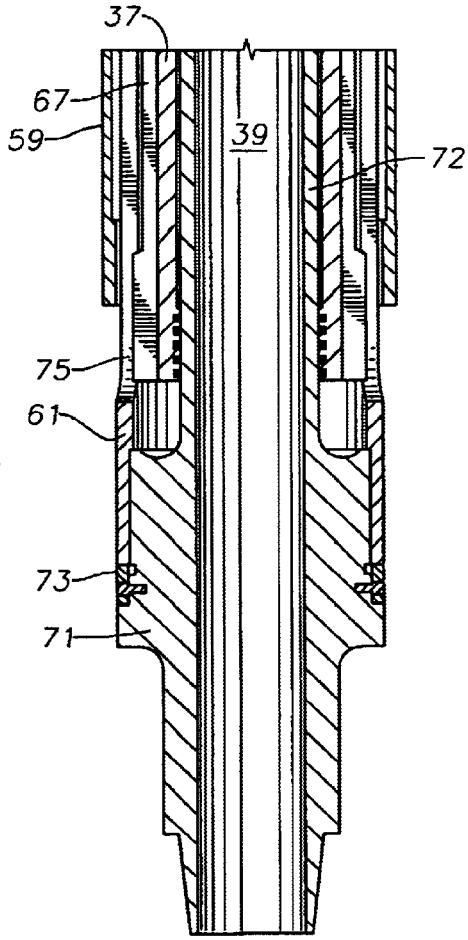
Figure 4B:
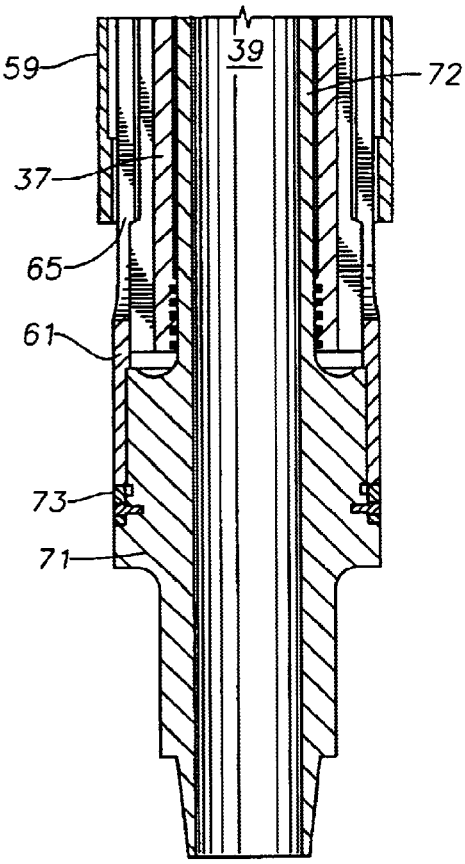

In operation, referring to FIG. 1, the operator secures casing 29 to casing hanger 27, and casing hanger 27 to running tool 25. Locator and hold down tool 31 is secured to the upper end of the running tool 25. The entire assembly is lowered through the well with drill pipe 35. Locator tool 31 will initially be in its extended position shown in FIG. 2A-2B. Initially, casing hanger 27 will land on the shoulder in landing sub 15 (FIG. 1). Upper body 43 (FIG. 2A) of tool 31 will be spaced above the landing sub 19 at this point. Continued weight of the drill string 35 causes mandrel 37 and upper body 43 to move downward in unison with lower body 61. Downward movement occurs until the lower end of upper body 43 reaches the contracted position, which is shown in FIGS. 3A and 3B. Upper body skirt 59 and mandrel 37 will have telescoped downward relative to the lower body 61. Shoulder 63 will be spaced close to collar 69. Locking elements 33 will be radially aligned with the profile in locator tool hold down sub 21 (FIG. 1), however, will not have moved radially outward yet.

Continued downward movement due to the weight of drill pipe 35 will overcome the force of split ring 45, causing mandrel 37 to move further downward relative to upper body 43 until collar 47 engages stop 49 as shown in FIG. 4A. Split ring 45 ratchets on grooves 41. As this occurs, collet member 55 will move downward relative to locking elements 33, with cam surface 53 pushing locking elements 33 radially outward to the position shown in FIG. 4A. Locking elements 33 will engage the recess in locator tool hold down sub 21 (FIG. 1). An upward pull by the operator will be resisted by locking elements 33, and indicate to the operator that the assembly has been properly located and locked in place.

The operator then cements conventionally by pumping through drill pipe 35 and out a cement shoe at the lower end of casing 29 (FIG. 1). The cement returns flow upward around casing 29, through slots in casing hanger 27, and past running tool 25 and locator tool 31. Any tendency for casing hanger 27 to float upward will be resisted by locking elements 33. After cementing, the operator sets seal 26 of casing hanger 27 in a conventional manner. If rotation is needed for running tool 25, as in this embodiment, the rotation of drill pipe 35 transmits through mandrel 37, pins 65, lower body 61 and its base 71. After completion and testing, the operator releases locator tool 31 by an upward pull of an amount that is sufficient to cause split ring 45 to release from grooves 41. As mandrel 37 moves upward relative to upper body 43, split ring 45 and collet member 55 return to the position shown in FIG. 2A. In that position, dogs 33 are free to move inward, allowing the assembly to be pulled from the well.

The invention has significant advantages. The locator tool informs the operator when the casing hanger has set on the proper landing shoulder. The tool also prevents the casing hanger from floating upward during cementing. Furthermore, the locator tool allows rotation of the drill string to be transmitted through to the running tool mechanism.

While the invention has been shown in only one of its forms, it should be apparent to those skilled in the art that it is not so limited but is susceptible to various changes without departing from the scope of the invention. For example, the locating tool and running tool mechanisms could be combined into a single tool.

What is claimed is:

1. An apparatus for installing a string of casing in a well, comprising:

a wellhead assembly having a landing shoulder and a profile located above the landing shoulder;

a casing hanger that lands on the landing shoulder of the sub for supporting the string of casing;

a running mechanism releasably secured to the casing hanger for landing the casing hanger and setting a casing hanger seal;

a body adapted to be carried above the running mechanism by a running string of conduit;

a plurality of dogs mounted to the body and movable into an engaged position in engagement with the profile, wherein while in the engaged position, the dogs resist upward movement of the casing hanger during cementing of the string of casing;

a mandrel that extends through the body, the mandrel having a threaded connection for connecting to the running string, the mandrel being axially movable relative to the body; wherein the body has an upper portion and a lower portion, the lower portion being secured to the running mechanism and rotatable relative to the upper portion; wherein axial movement of the mandrel relative to the body causes the dogs to move to the retracted and extended positions; and wherein the mandrel is rotatable relative to the upper portion of the body and rotates in unison with the lower portion of the body to transmit rotation of the running string to the running mechanism.

2. An apparatus for installing a string of casing in a well, comprising:

a wellhead assembly having a landing shoulder and a profile located above the landing shoulder;

a casing hanger that lands on the landing shoulder of the sub for supporting the string of casing;

a running mechanism releasably secured to the casing hanger for landing the casing hanger and setting a casing hanger seal;

a body adapted to be carried above the running mechanism by a running string of conduit;

a plurality of dogs mounted to the body and movable into an engaged position in engagement with the profile, wherein while in the engaged position, the dogs resist upward movement of the casing hanger during cementing of the string of casing; and wherein the body has a lower portion and an upper portion that are axially movable relative to one another, enabling the running string to be lowered after the casing hanger has landed on the landing shoulder.

3. The apparatus according to claim 2, wherein the dogs resist an upward pull to a selected level on the running string once they have engaged the profile, serving as indication that they are in the engaged position.

4. An apparatus for installing a string of casing in a well, comprising:

a wellhead assembly having a landing shoulder and a profile located above the landing shoulder;

a casing hanger that lands on the landing shoulder of the sub for supporting the string of casing;

a running mechanism releasably secured to the casing hanger for landing the casing hanger and setting a casing hanger seal;

a body adapted to be carried above the running mechanism by a running string of conduit;

a plurality of dogs mounted to the body and movable into an engaged position in engagement with the profile, wherein while in the engaged position the dogs resist upward movement of the casing hanger during cementing of the string of casing; wherein the body has a lower portion and an upper portion that are axially movable relative to one another from an extended position to a contracted position; and the apparatus further comprises:

a mandrel that extends through the upper and lower portions of the body, the upper end of the mandrel having a threaded connection for connecting to the running string, the mandrel being axially movable relative to the upper and lower portions of the body from an upper position to a lower position;

a latch between the upper portion of the body and the mandrel for releasably preventing downward movement of the mandrel from the upper position, wherein continued downward movement of the running string after the casing hanger lands on the landing shoulder first causes the upper portion of the body and the mandrel to move downward in unison relative to the lower portion of the body to the contracted position, the latch being releasable in response to increased weight, thus causing the mandrel to move from the upper position downward relative to the upper and lower portions of the body after the body is in the contracted position; and wherein downward movement of the mandrel relative to the upper and lower portions of the body to the lower position causes the dogs to move to the engaged position.

5. An apparatus for installing a string of casing in a well, comprising:

a wellhead assembly having a landing shoulder and a profile located above the landing shoulder;

a casing hanger that lands on the landing shoulder of the sub for supporting the string of casing;

a running mechanism releasably secured to the casing hanger for landing the casing hanger and setting a casing hanger seal;

a body adapted to be carried above the running mechanism by a running string of conduit;

a plurality of dogs mounted to the body and movable into an engaged position in engagement with the profile, wherein while in the engaged position, the dogs resist upward movement of the casing hanger during cementing of the string of casing; and wherein the body has a lower portion and an upper portion that are axially movable and rotatable relative to one another, enabling the running string to be lowered after the casing hanger has landed on the landing shoulder, and enabling rotation of the running string to be transmitted through the upper portion of the body to the running mechanism.

6. In an apparatus for installing a string of casing in a well, a casing hanger that lands on a landing shoulder of the wellhead assembly and is secured to the string of casing, a running mechanism releasably secured to the casing hanger for landing the casing hanger and setting a casing hanger seal, the improvement comprising:

a profile formed in the wellhead assembly above the landing shoulder;

a body having, an upper portion and a lower portion, the lower portion being secured to the running mechanism;

a mandrel mounted to the body for axial movement relative to the body, the mandrel having a threaded upper end for securing to a running string of conduit;

a cam surface on the mandrel;

a plurality of dogs mounted to the upper portion of the body in sliding engagement with the cam surface for movement in response to axial movement of the mandrel into an engaged position in engagement with the profile provided in the sub, wherein while in the engaged position, the dogs resist upward movement of the casing hanger during cementing of the string of casing; and wherein the lower portion of the body and the mandrel are rotatable relative to the upper portion of the body to transmit rotation of the running string from the mandrel, through the lower portion of the body and to the running mechanism.

7. The apparatus according to claim 6, wherein the dogs move to the engaged position in response to downward movement of the mandrel relative to the body.

8. In an apparatus for installing a string of casing in a well, a casing hanger that lands on a landing shoulder of the wellhead assembly and is secured to the string of casing, a running mechanism releasably secured to the casing hanger for landing the casing hanger and setting a casing hanger seal, the improvement comprising:

a profile formed in the wellhead assembly above the landing shoulder;

a body having an upper portion and a lower portion, the lower portion being secured to the running mechanism;

a mandrel mounted to the body for axial movement relative to the body, the mandrel having a threaded upper end for securing to a running string of conduit;

a cam surface on the mandrel;

a plurality of dogs mounted to the upper portion of the body in sliding engagement with the cam surface for movement in response to axial movement of the mandrel into an engaged position in engagement with the profile provided in the sub, wherein while in the engaged position, the dogs resist upward movement of the casing hanger during cementing of the string of casing;

wherein the upper and lower portions of the body are axially movable from an extended position to a contracted position, and wherein the apparatus further comprises:

a releasable latch between the upper portion of the body and the mandrel, the latch causing the mandrel to move downward with the upper portion of the body and the running string after the casing hanger has landed until the upper and lower portions of the body reach the contracted position, the latch then releasing the mandrel upon application of additional weight to move downward relative to the upper and lower body portions to cause the cam surface to move the dogs to the engaged position.

9. A method for installing a casing hanger and string of casing in a wellhead assembly, comprising:

(a) releasably securing a running mechanism to the casing hanger;

(b) providing a body with a plurality of radially movable dogs and mounting the body to the running mechanism;

(c) with a running string of conduit, lowering the casing hanger, running mechanism and body into the well and landing the casing hanger on a landing shoulder in the wellhead assembly; then (d) extending the dogs radially outward to a profile provided in the wellhead assembly; then (e) cementing the casing, the engagement of the dogs with the profile resisting upward movement of the casing hanger due to the cementing; then (f) with the running mechanism, setting a seal between the casing hanger and the wellhead assembly; then (g) retrieving the running mechanism and the body with the running string; and after step (d) and before step (e), pulling upward with the running string, the upward pull being resisted by the engagement of the dogs with the profile, indicating proper positioning of the casing hanger.

10. The method according to claim 9, wherein:

step (d) is performed by axially moving the running string relative to the body.

11. The method according to claim 9, wherein:

step (d) is performed by moving the running string straight downward relative to the body.

12. The method according to claim 9, wherein:

step (f) is performed by rotating the running string and transmitting the rotation through the body to the running mechanism.

* * * * *